US007899371B2

(12) United States Patent
Takuwa

(10) Patent No.: US 7,899,371 B2
(45) **Date of Patent: *Mar. 1, 2011**

(54) IMAGE FORMING AND TONER SUPPLY APPARATUS

(75) Inventor: Noriyuki Takuwa, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/700,112

(22) Filed: Feb. 4, 2010

(65) Prior Publication Data

US 2010/0178081 A1 Jul. 15, 2010

Related U.S. Application Data

(63) Continuation of application No. 11/435,515, filed on May 17, 2006, now Pat. No. 7,676,182.

(51) Int. Cl.
*G03G 15/08* (2006.01)

(52) U.S. Cl. ..... 399/258; 399/119; 399/120

(58) Field of Classification Search ..... 399/119, 399/120, 258

See application file for complete search history.

(56) References Cited

U.S. PATENT DOCUMENTS 5,194,897 A 3/1993 Yoshiyama et al.
6,151,471 A 11/2000 Yahata et al.
6,879,789 B2 * 4/2005 Yamada et al. ..... 399/106
6,934,494 B2 8/2005 Yamada et al.
2003/0081968 A1 5/2003 Minagawa

FOREIGN PATENT DOCUMENTS

JP 07-253713 10/1995
JP 2000-112214 4/2000
JP 2001-194879 7/2001

OTHER PUBLICATIONS

U.S. Office Action dated Jan. 27, 2009 corresponding to U.S. Appl. No. 11/435,515.
U.S. Office Action dated Aug. 13, 2009 corresponding to U.S. Appl. No. 11/435,515.

* cited by examiner

*Primary Examiner*—Ryan D Walsh
(74) *Attorney, Agent, or Firm*—Turocy & Watson, LLP

(57) ABSTRACT

This invention provides a buffering block with a Mylar bonded on the upper surface of an urethane rubber made base material on the bottom surface of the inserting port of an inserting side frame to support a toner bottle. When a toner bottle is slid and taken out from a copying machine, its inclined portion and cap portion run against the buffering block. Thus, a shock given to the toner bottle when taken out from the copying machine is eased and toner adhered around the cap portion is prevented from dropping to and contaminating the periphery of the inserting side frame.

11 Claims, 6 Drawing Sheets

IMAGE FORMING AND TONER SUPPLY APPARATUS

CROSS-REFERENCE TO RELATED APPLICATIONS

This application is a Continuation of application Ser. No. 11/435,515 filed May 17, 2006, the entire contents of which is hereby incorporated by reference.

FIELD OF THE INVENTION

The present invention relates to an image forming apparatus to detachably support a toner supply container to supply toner to a developing device in an image forming apparatus using an electro-photographic process such as copying machine, printer, etc.

DESCRIPTION OF THE BACKGROUND

In an image forming apparatus using an electro-photographic process such as copying machine, printer, etc., toner is supplied to a developing device. There is a toner bottle of which top is inserted directly into a toner supply mechanism at the main body side of an image forming apparatus to supply toner by rotating with the driving of the supply mechanism. The toner bottle emptied after supplying toner is pulled out from the main body of an image forming apparatus and exchanged with a new toner bottle. The inserting portion of such a toner bottle is formed thinner than the toner containing portion. That is, there is a step produced between its toner containing portion and the inserting portion.

To exchange such a toner bottle with a new one, the emptied bottle is pulled out from the main body of an image forming apparatus by sliding it along a stay supporting a toner bottle in the main body of the image forming apparatus. And in order to prevent toner from spilled out from a toner bottle when exchanging it with a new bottle, a shutter is provided at a toner discharging port of the toner bottle.

However, in case of a conventional image forming apparatus, as there is a step between the toner containing portion and the inserting portion of a toner bottle, the inserting portion of a toner bottle is struck against the inserting portion of the stay when a toner bottle is pulled out from the main body of an image forming apparatus. As a result, there was such a trouble caused to contaminate the inside of the main body of the image forming apparatus at the near portion of the inserting port of the stay by the toner adhered to the inserting portion dropped by the shock even if there is a shutter provided at the toner discharging port.

So, an image forming apparatus capable of preventing its inside from being contaminated by toner by preventing toner adhered to a toner bottle from dropping by the shock when pulling out a toner bottle by sliding it along the stay is desired.

SUMMARY OF THE INVENTION

Accordingly, an advantage of the present invention is to provide an image forming apparatus without causing the drop of toner adhered to a toner bottle even when pulling out a toner bottle by sliding it along the stay when exchanging it with a new toner.

To achieve the above advantage, one aspect of the present invention is to provide an image forming apparatus, comprising a toner supply mechanism to supply toner to a developing device; a supporting member to support a detachable toner supply container to the toner supply mechanism detachably; and a buffering member swingably projected from the bottom surface of the inserting port side of the supporting member.

DETAILED DESCRIPTION OF THE INVENTION

Figure 1:
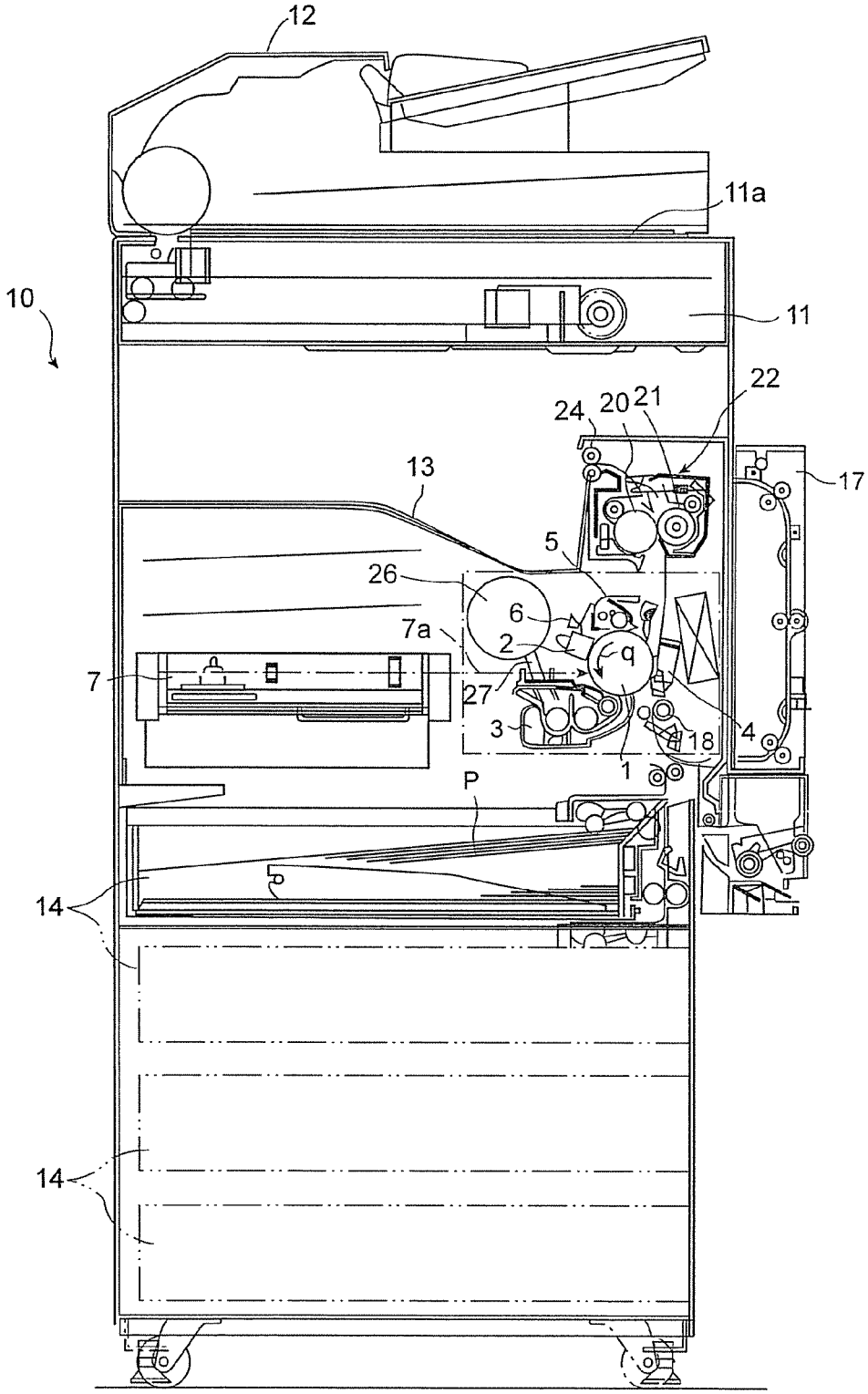
FIG. 1 is a schematic construction diagram showing a copying machine in a first embodiment of this invention.

Hereinafter, the first embodiment of this invention will be explained in detail referring to the attached drawings. FIG. 1 is a schematic construction diagram showing a copying machine 10 that is an image forming apparatus in the first embodiment of this invention. A scanner 11 is provided on a document reading glass 11*a* above copying machine 10 to read documents placed on document reading glass 11*a* or documents conveyed by an automatic document feeder 12.

Below scanner 11 and separated from copying machine 10 by a paper discharging portion 13 in the main body, there are a photosensitive drum 1, a main charger 2 which uniformly charges photosensitive drum 1 sequentially according to the rotating direction of an arrow mark q of photosensitive drum 1, a laser exposing unit 7 to form a latent image by irradiating laser light 7*a* to charged photosensitive drum based on image data from scanner unit 11, a developing unit 3, a transfer/separating charger 4, a cleaner 5, and a charge eliminating LED 6 provided. Developing unit 3 is a magnetic brush type developing unit well-known so far to make the development using two-component developing agents comprising toner and carrier. Developing unit 3 is supplied with toner by a toner bottle 26 that is a toner supply container installed above the unit according to toner density in the developing agent. At the rear side of copying machine 10, a toner supply unit 27 is provided. Toner supply unit 27 conveys toner supplied from toner bottle 26 and supplies it to developing unit 3.

Under copying machine 10, a paper supply cassette 14 is provided to supply sheet paper P in the direction of transfer position of photosensitive drum 1. Further, copying machine 10 is equipped with a paper supply tray 14 to manually supply sheet paper P and a reverse conveying mechanism 17 to reverse sheet paper P in the both side image forming. 18 is an aligning roller to align the leading edges of sheet paper P supplied from paper supply cassette 14, paper supply tray 16 or reverse conveying mechanism 17 and conveys sheet paper P in the direction of photosensitive drum 1 in synchronous with a toner image. At the downstream of the transfer position of photosensitive drum 1, a fixing device 22 that is a fixing unit is provided to heat, pressurize and fix a toner image by conveying sheet paper P while clamping paper with a heat roller 20 and pressure roller 21. At the downstream of fixing device 22, a paper discharging roller 24 is provided to discharge sheet paper P after fixing to a paper discharging unit 13.

Figure 2:
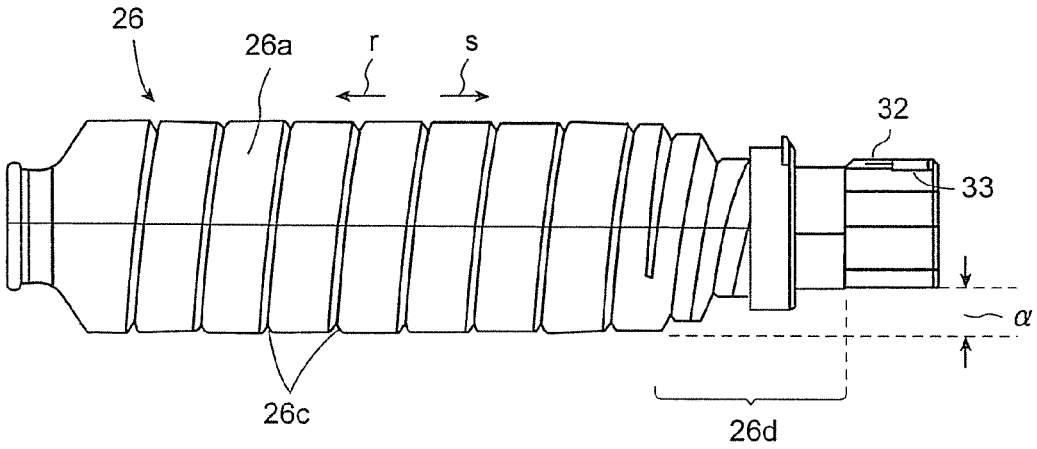
FIG. 2 is a side view showing a toner bottle in the first embodiment of this invention.

Next, a toner bottle 26 and its supporting member will be explained in detail. Toner bottle 26 has a nearly cylindrical shape toner containing portion 26*a* and a cap portion 26*b* that is attached to a toner supply unit 27 as shown in FIG. 2. Around toner containing portion 26*a*, a spiral shape conveying groove 26*c* is formed. When toner bottle 26 is rotated by the driving of toner supply unit 27, toner in toner containing portion 16*b* is guided to conveying groove 26*c* and conveyed in the direction of cap portion 26*b*.

Cap portion 26*b* is thinner than toner containing portion 26*a* and produces a step α between it and toner containing portion 26*a*. Between toner containing portion 26*a* and cap portion 26*b* becomes a step-like inclined portion 26*d*. Cap portion 26*b* is provided with a shutter 32 that opens/closes a toner discharging port 33. Shutter 32 closes toner discharge port 33 when toner bottle 26 is removed from toner supply unit 27 in order to prevent toner from dropping from toner discharge port 33 at the time when toner bottle 26 is exchanged.

Figure 3:
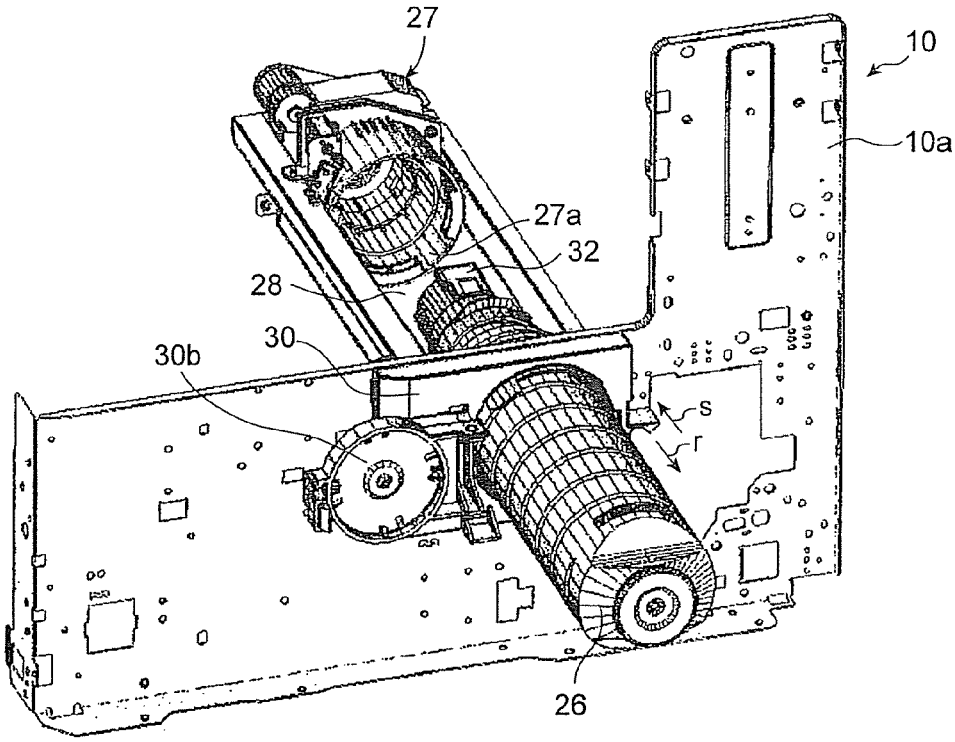
FIG. 3 is a schematic perspective view showing the attaching/detaching to/from a toner bottle of a copying machine in the first embodiment of this invention.

There are a bottle stay 28 that is a supporting member and an inserting side frame 30 provided between a front frame 10*a* and a rear side toner supply unit 27 as shown in FIG. 3. Bottle stay 28 is made of, for example, a mold member that has a good sliding property. A toner bottle 26 passes through an inserting port 30*a* of inserting side frame 30, slides along bottle stay 28 and installed/removed to/from toner supply unit 27. Inserting side frame 30 has a cover 30*b* to fix the rear end of toner bottle 26 after installing toner bottle 26 to toner supply unit 27.

Figure 4:
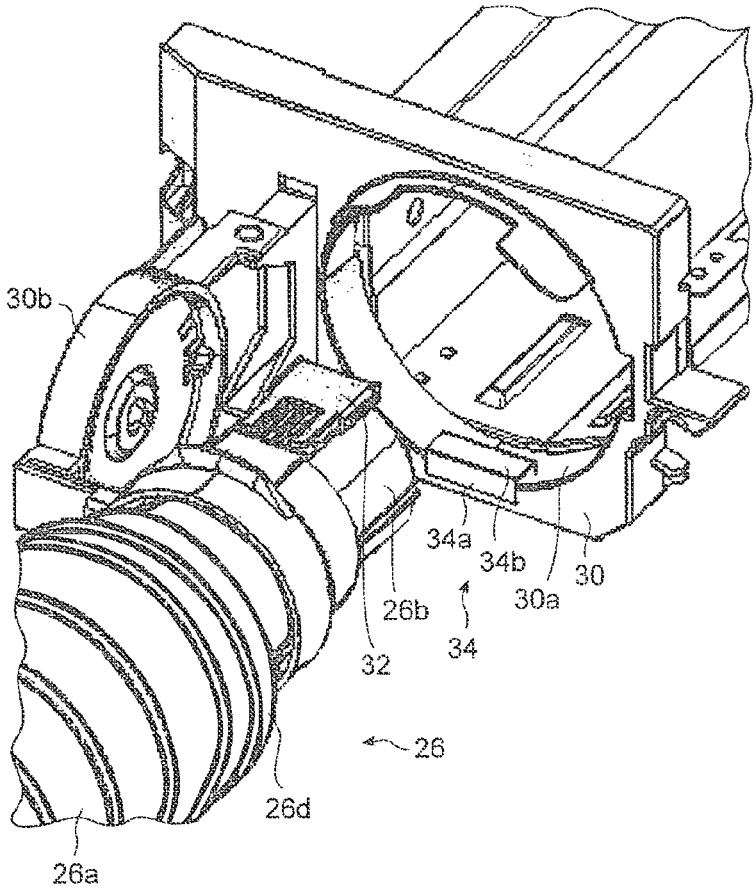
FIG. 4 is a schematic perspective view showing the inserting side frame in the first embodiment of this invention.

On the bottom surface of inserting port 30*a* of inserting side frame 30, a buffering block 34 that is a buffering member is provided as shown in FIG. 4. Buffering block 34 has a Mylar (Trade Mark) 34*b*, that is a sliding member bonded on the upper surface of an urethane rubber made base material 34*a* that is a foaming material. Buffering block 34 is projecting from the bottom surface of inserting port 30*a*. Thus, an inclined portion 26*d* and cap portion 26*b* of toner bottle 26 are brought in contact with buffering block 34 when passing inserting port 30 so as to relief the shock of being stricken to the bottom surface of inserting port 30*a*.

Next, the operations will be described. When the image forming process starts, photosensitive drum 1 is uniformly changed by main charger 2 according to the rotation in the direction of arrow mark q and an electrostatic latent image is formed by laser exposing unit 7 according to an image signal. Thereafter, photosensitive drum 1 reaches developing unit 3 and a toner image is formed thereon. The toner image formed on photosensitive drum 1 is transferred on a sheet paper, etc. by transfer/separation charger 4. After completing the transfer of a toner image, photosensitive drum 1 becomes ready to forming of next image after processed by cleaner 5 and electric charge eliminator 6. Further, a sheet paper with a toner image transferred is discharged in paper discharging portion 13 in the main body after fixed by fixing unit 22.

When the drop of toner density in developing unit 3 is detected while such the image forming process is carried out, toner is supplied from toner bottle 26. Toner bottle 26 is rotated by the rotating drive of toner supply unit 27. Toner in toner containing portion 26*a* is conveyed in the direction of toner discharging port 33 sequentially along conveying groove 26*c* to toner supply unit 27 and further, to developing unit 3. When toner density in developing unit 3 reaches required density, toner supply unit 27 is stopped to drive.

When toner bottle 26 is emptied by the toner supply operation, toner bottle 26 is slid in the arrow direction r and cap portion 26*b* is taken out from toner supply unit 27. In conjunction with this operation, shutter 32 closes toner discharging port 33. Thereafter, toner bottle 26 is further slide in the arrow direction r in the state supported by bottle stay 28 and taken out from copying machine 10. While being slid, toner bottle 26 is in contact with buffering block 34. However, the toner bottle is smoothly slid without receiving a frictional resistance by buffering block 34 because Mylar 34*b* is bonded on the upper surface of buffering block 34.

Further, when inclined portion 26*d* and cap portion 26*b* of toner bottle 26 reach inserting side frame 30, the bottle cannot pass through inserting port 30*a* for the step with toner containing portion 26*a*. However, inclined portion 26*d* and cap portion 26*b* of toner bottle run against elastic buffering block 34 at an inserting side frame 830. Thus, the shock generated to toner bottle 26 when inclined portion 26*d* and cap portion 26*b* pass through inserting side frame 30 is absorbed by buffering block 34. As a result, toner adhered around cap portion 26*b* is prevented to drop around inserting side framed 30. Then, a new toner bottle 26 is inserted into copying machine 10 through inserting side frame 30. A new toner bottle 26 is slid in the arrow direction s along bottle stay 28 and cap portion 26*a* is installed to toner supply unit 27. Further, even if toner adhered around cap portion 26*d* drops on buffering block 34 when toner bottle 26 is pulled out, as Mylar 34*b* is bonded on its upper surface, it becomes easy to wipe off dropped toner.

According to this first embodiment, buffering block 34 is provided on the bottom surface of inserting port 30*a* of inserting side frame 30 that supports toner bottle 26. AS a result, even if toner bottle 26 is slid along bottle stay 28 and taken out from copying machine 10, a shock generated when inclined portion 26*d* and cap portion 26*b* run against inserting side frame 30 can be relieved by the step produced with toner containing portion 26*a*. Therefore, even when toner bottle 26 is taken out by sliding along bottle stay 28 in, for example, one hand, toner adhered to cap portion 26*b* is prevented from dropping when inclined portion 26*d* and cap portion 26*b* pass through inserting side frame 30. As a result, it is possible to take out toner bottle 26 easily and the contamination around inserting side frame 30 by dropping toner can be prevented. Furthermore, as Mylar 34*b* is bonded on the upper surface of buffering block 34, the sliding movement of toner bottle 26 is not impaired. In addition, when toner is adhered to buffering block 34, it can be easily wiped off.

Next, a second embodiment of this invention will be explained. In this second embodiment, the buffering member is in a construction differing from that in the first embodiment described above but all other elements are the same as those in the first embodiment. Therefore, in this second embodiment, the same component elements as those in the first embodiment will be assigned with the same reference numerals and the detailed explanation thereof will be omitted.

Figure 5:
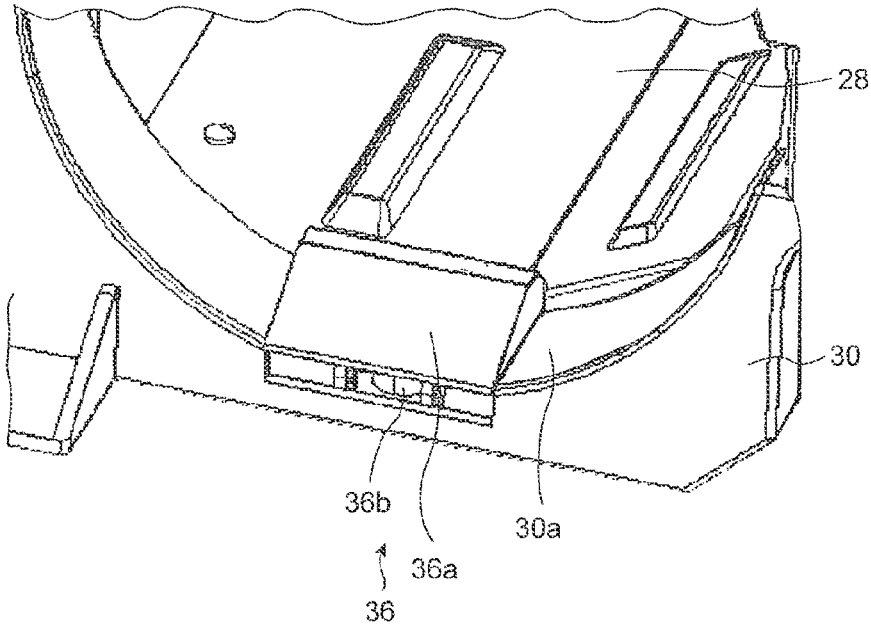
FIG. 5 is a schematic perspective view showing the inserting side frame in a second embodiment of this invention.

As shown in FIG. 5, in the second embodiment, an elastic plate 36 that is a buffering member is provided on the bottom surface of inserting port 30*a* of inserting side frame 30. Elastic plate 36 has a slider 36*a* made of a mold member that is a sliding member and a coil spring 36*b* that is an elastic matter. Coil spring 36*b* supports slider 36*a* so that it is able to swing.

Slider 36*a* is able to slide a toner bottle smoothly without generating friction resistance to toner bottle 26. Slider 36*a* is inclined to become high toward bottle stay 28 side. In the free state, slider 36*a* projects higher than the bottom surface of inserting port 30*a* at the bottle stay side, while almost the same height as the bottom surface of inserting port 30*a* at the inlet port side.

As a result, inclined portion 26*a* and cap portion 26*b* of toner bottle 26 are supported by slider 36 that is pushed up by coil spring 36*b* when toner bottle 26 is taken out from copying machine 10, and irrespective of a step produced between toner containing portion 26*a* to cap portion 26*b*, a shock applied to toner bottle 26 when struck against the bottom surface of inserting port 30*a* is relieved. AS a result, toner adhered around cap portion 26*b* is prevented from dropping to the surrounding area of inserting side frame 30. On the other hand, when installing toner bottle 26 into copying machine 10, the leading end of slider 36*a* does not interfere with inclined portion 26*d* of toner bottle 26 and toner bottle 26 is able to pass through the position of elastic plate 36 smoothly.

According to the second embodiment, there is elastic plate 36 provided on the bottom surface of inserting port 30*a* of inserting side frame 30 that supports toner bottle 26. As a result, likewise the first embodiment, the shock produced when inclined portion 25*d* and cap portion 26*b* run against inserting side frame 30 can be relieved. Accordingly, when exchanging toner bottle 26, the drop of toner adhered to cap portion 26*b* can be prevented and the contamination around inserting side frame 30 can be prevented. Furthermore, as slider 36*a* is inclined, the leading end of slider 36*a* is not caught and toner bottle 26 can be inserted smoothly.

Next, the third embodiment of this invention will be explained. In this third embodiment, the construction of a buffering member is different from that in the first embodiment described above but all other elements are the same as those in the first embodiment. Therefore, in this third embodiment, the same structural elements as those explained in the first embodiment will be assigned with the same reference numerals and the detailed explanation thereof will be omitted.

Figure 6:
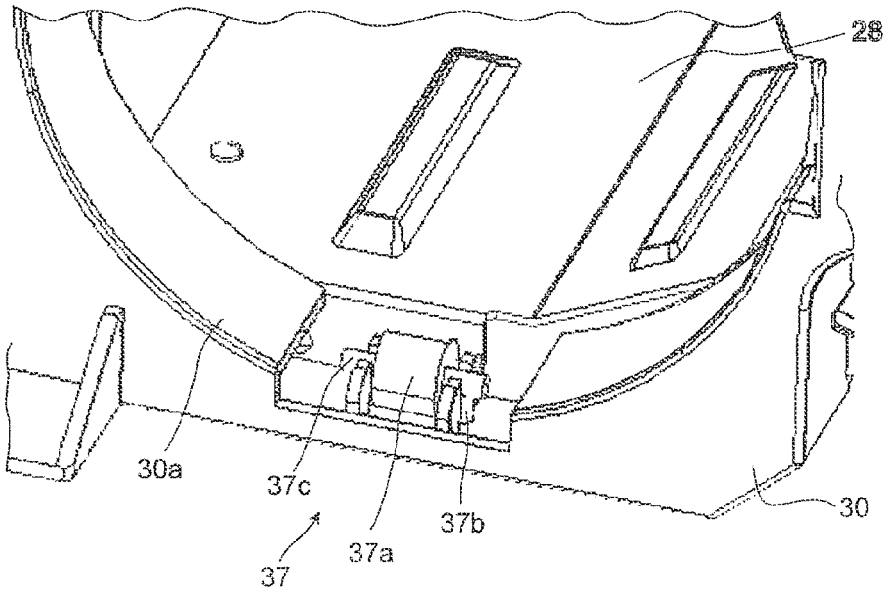
FIG. 6 is a schematic perspective view showing the inserting side frame in a third embodiment of this invention.

In the third embodiment, elastic roller 37 that is a buffering member is provided on the bottom surface of inserting port 30*a* of inserting frame 30 as shown in FIG. 6. Elastic roller 37 is a sliding member and has a roller 37*a* freely rotating against a shaft 37*c* and a coil spring 37*b* that is an elastic matter. Coil spring 37*b* supports shaft 37*c* of roller 37*a* so as to swing. Since roller 37*a* is able to rotate freely, it is possible to smoothly slide a toner bottle without causing frictional resistance. In the free state, the upper portion roller 37*a* is projecting from the bottom surface of inserting port 30*a*.

Thus, when toner bottle 26 is taken out from copying machine 10, inclined portion 26*d* and cap portion 26*b* of toner bottle 26 are supported by roller 37*a* that is pushed up by coil spring 37. Therefore, irrespective of a step extending to cap portion 26*b* from toner containing portion 26*a*, a shock produced when stricken against the bottom surface of inserting port 30*a* is relieved. As a result, toner adhered around cap portion 26*b* is prevented from dropping around inserting side frame 30. Further, as roller 37*a* freely rotates according to the sliding direction of toner bottle 26, when inserting toner bottle 27 into copying machine 10, roller 37*a* rotates in the inserting direction so as to pass toner bottle smoothly.

According to this third embodiment, there is elastic roller 37 is provided on the bottom surface of inserting port 30*a* of inserting side frame 39 that supports toner bottle 26. By this construction, likewise the first embodiment, a shock produced when inclined portion 26*d* and cap portion 26 run against inserting side frame 30 can be relieved. Accordingly, toner adhered to cap portion 26*b* is prevented from dropping when toner bottle 26 is exchanged and the contamination around inserting side frame 30 can be prevented. Furthermore, since roller 37*a* freely rotates along the sliding direction of toner bottle 26, roller 37*a* is able to insert toner bottle 26 smoothly without becoming a resistance.

Next, a fourth embodiment of this invention will be explained. In this fourth embodiment, a buffering member is also provided at a toner supply mechanism in the first embodiment and all other elements are the same as the first embodiment. Therefore, in this fourth embodiment, the construction elements as those in the first embodiment will be assigned with the same reference numerals as those in the first embodiment and the detailed explanation thereof will be omitted.

Figure 7:
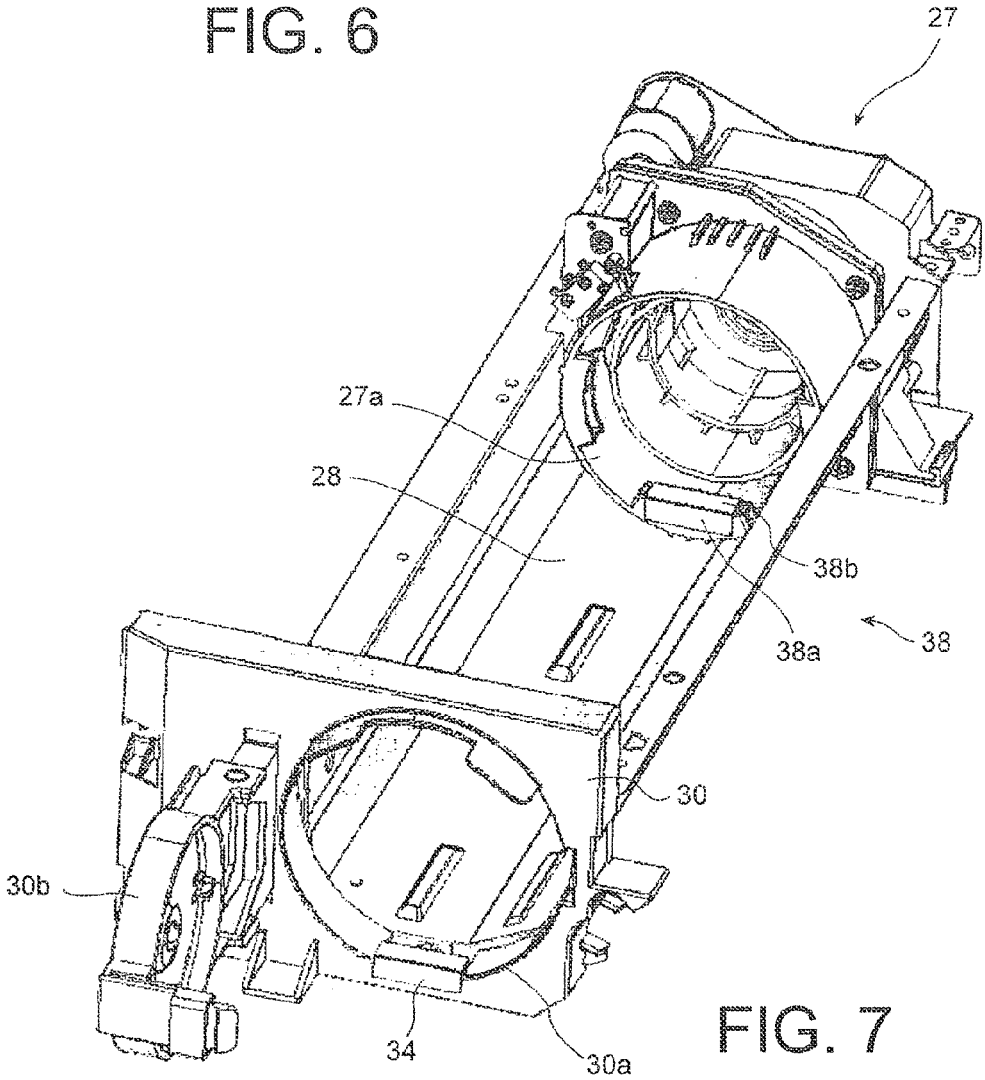
FIG. 7 is a schematic perspective view showing the inserting side frame, a the bottle stay and a toner supply device in a fourth embodiment of this invention.
Figure 8:
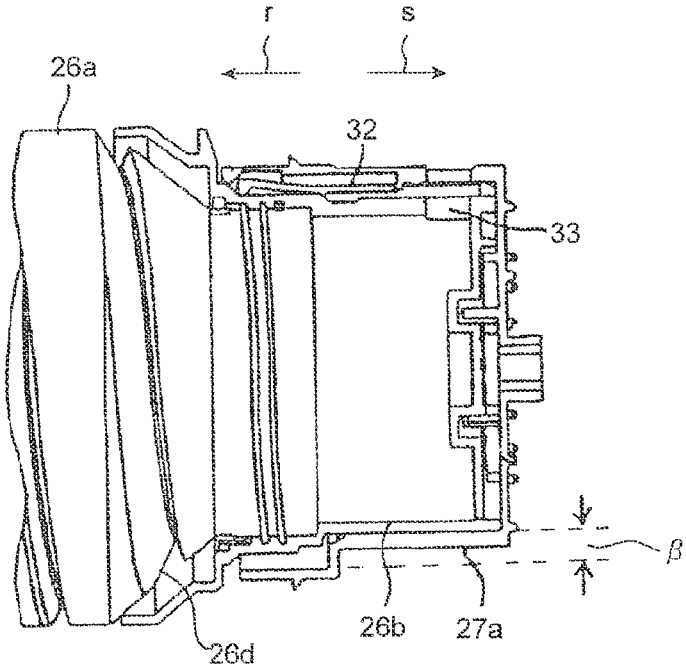
FIG. 8 is a schematic explanatory diagram showing the state of a cap portion installed to a cap guide in the fourth embodiment of this invention.

In the fourth embodiment, a second buffering block 38 that is a second buffering member is provided on the bottom surface of cap guide 27*a* of toner supply unit 27 as shown in FIG. 7. Second buffering block 38 has, for example, Mylar 38*b* bonded on the upper surface of urethane rubber made base material 38*a* likewise buffering block 34. When toner bottle 26 is inserted in toner supply unit 27, a step β is produced between cap guide 27*a* and cap portion 26*b* at the inserting side portion of cap guide 27*a* as shown in FIG. 8. Therefore, when cap portion 26*b* is taken out from cap guide 27*a* when exchanging toner bottle 26, cap portion 26*b* drops for the step β. However, cap portion 26*b* is brought in contact with second elastic buffering block 38 and a shock resulting from dropping is absorbed. Thus, toner adhered around cap portion 26*b* is prevented from dropping to the periphery of cap guide 27*a*.

According to this fourth embodiment, it is possible to prevent the contamination around inserting side frame 30 by toner dropping by buffering block 34 when exchanging toner bottle 26. Further, the contamination around cap guide 27*a* caused by toner dropping can be prevented by second buffering block 38.

Further, in this fourth embodiment, second buffering block 38 is used as a second buffering member but not restricting to this, any elastic member in the similar shape as an elastic plate to push up the slider in the second embodiment or elastic roller 37 to push up shaft 37*c* of roller 37*a* with coil spring 37*b* can be used as a second buffering member.

Next, a fifth embodiment of this invention will be explained. In this fifth embodiment, a detecting member to detect the swing of a buffering member is provided in the second embodiment and all other elements are the same as those in the second embodiment. Therefore, in this fifth embodiment, the same structural elements explained in the second embodiment will be assigned with the same reference numerals and the detailed explanation thereof will be omitted.

Figure 9:
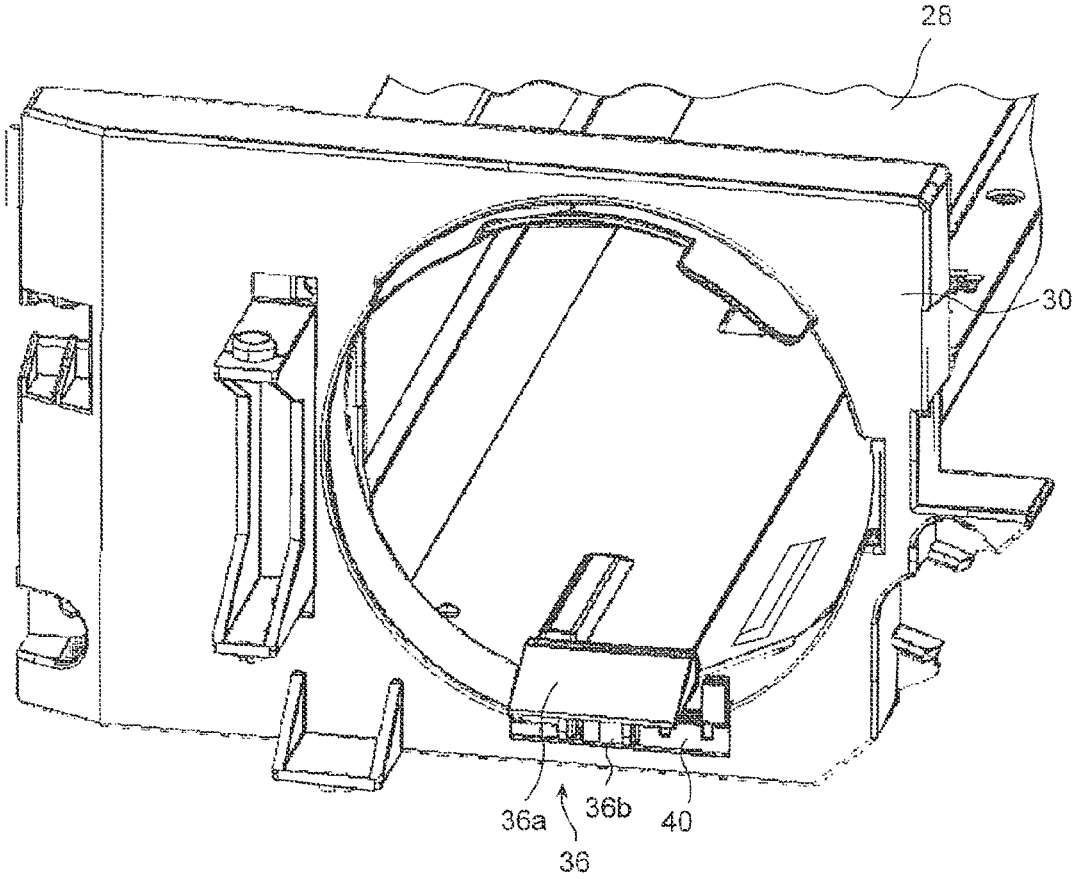
FIG. 9 is a schematic perspective view showing the inserting side frame in a fifth embodiment of this invention.

In the fifth embodiment, a micro-sensor 40 that is a detecting member is provided below slider 36*a* of elastic plate 36 as shown in FIG. 9. When there is toner bottle 26 at the position of inserting port 30*a*, this micro-sensor 40 is pushed down to the lower surface of slider 36*a* that is pushed by toner bottle 26 and is turned ON. Where there is no toner bottle 26 at the position of inserting port 30*a*, slider 36*a* is pushed up by coil spring 36*b*, micros-sensor 40 is turned OFF. When, for example, the front cover is closed although micro-sensor 40 is in the OFF state without detecting toner bottle 26 at the time when exchanging toner bottle 26, a warning is shown on a panel indicating that no toner bottle 26 is inserted. On the other hand, when micro-sensor 40 is pushed by slider 36*a* and turned ON when exchanging toner bottle 26 and it is detected that toner bottle 26 is inserted, toner supply unit 27 becomes rotatable and toner can be supplied. Thus, it is prevented that toner supply unit 27 is driven by forgetting to insert new toner bottle 26 into copying machine 10.

According to this fifth embodiment, it is possible to prevent forgetting to insert new toner bottle 26 into copying machine 10 when exchanging toner bottle 26.

Figure 10:
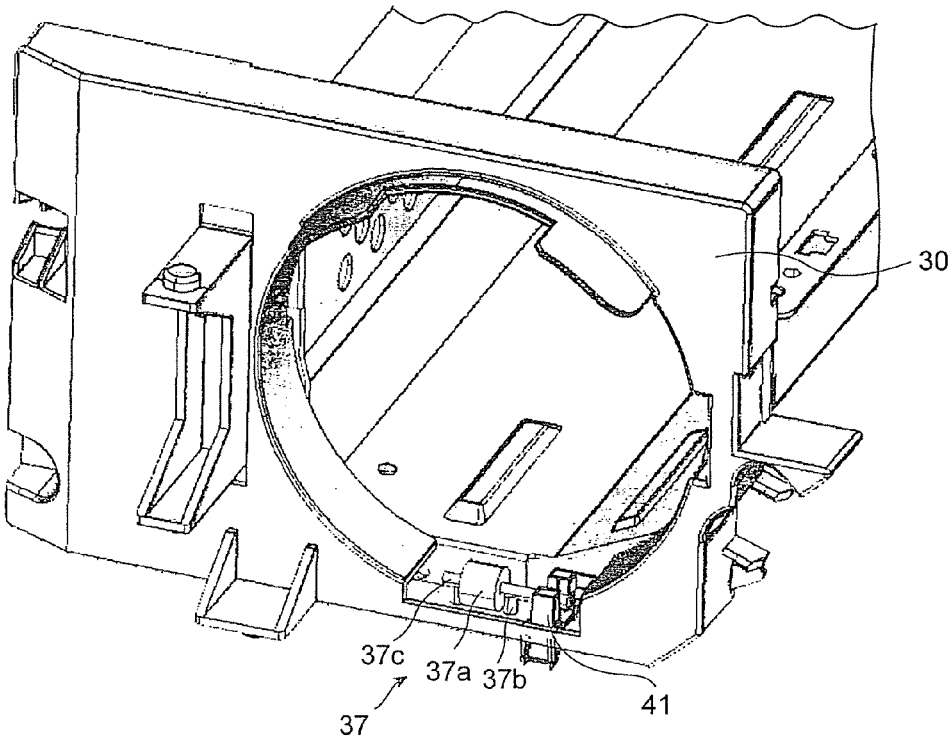
FIG. 10 is a schematic perspective view showing the inserting side frame in a sixth embodiment of this invention.

Further, in this fifth embodiment, a micro-switch which is switched by contact with toner bottle 26 is used as a detecting member but not restricting to this micro-switch, for example, a transmission photo-sensor 41 that is switched with the swing of shaft 37*c* of elastic roller 37 may be used as a detecting member as in the sixth embodiment shown in FIG. 10.

Next, a seventh embodiment of this invention will be explained. In this seventh embodiment, a buffering member and a detecting member to detect a toner supply container are provided at the toner supply mechanism side in the fifth embodiment and all other component elements are same as those in the fifth embodiment. Therefore, in this seventh embodiment, the same structural components as those explained in the fifth embodiment will be assigned with the same reference numerals and the detailed explanation thereof will be omitted.

Figure 11:
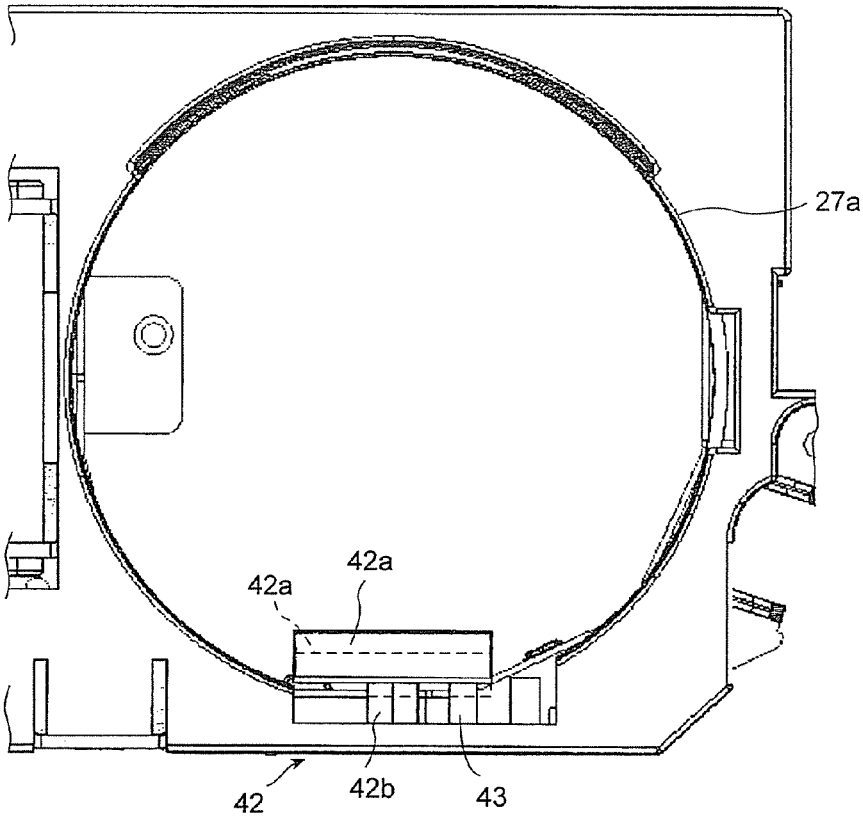
FIG. 11 is a schematic explanatory diagram showing the cap portion in a seventh embodiment of this invention.

In the even embodiment, a second elastic plate 42 that is a second buffering member is provided on the bottom surface of cap guide 27*a* of toner supply unit 27 as shown in FIG. 11. Further, under second slider 42*a* of second elastic plate 42, a micro-sensor 43 that is a second detecting member is provided. Thus, the shock by the drop of cap portion 26*b* produced when cap portion 26*b* is taken out from cap guide 27*a* is absorbed by elastic plate 42.

Further, normally when cap portion 26*b* of toner bottle 26 is properly attached to toner supply unit 27, second slider 42*a* is pushed up by coil spring 42*b* and second micro-sensor 43 is turned OFF as shown by the solid line in FIG. 11. Therefore, when second micro-sensor is OFF, for example, when the front cover is closed after completing the exchanging operation of toner bottle 26, a controller of copying machine 10 recognizes that new toner bottle 26 is properly attached to toner supply unit 27.

On the other hand, if second micro-sensor 43 is ON when the front cover is closed after completing the exchanging operation of toner bottle 26, cap portion 26*b* may possibly be shifted from bottle guide 27*a* and push down second slider 42*a* as shown by the dotted line shown in FIG. 11. In such the case, a warning is displayed on the panel indicating that cap portion 26*b* is not surely attached to toner supply unit. Thus, it is prevented to drive toner supply unit 27 without cap portion 26*b* properly inserted when exchanging toner bottle 26.

According to this seventh embodiment, toner supply unit is prevented to be driven without new toner bottle 26 inserted properly.

Further, the application of this invention is not restricted to the above embodiments but can be modified variously within the scope of the invention. For example, the number of toner supply mechanisms equipped to an image forming apparatus is optional depending on the number of toners used in the image forming. Further, the construction of buffering member and others are not restricted provided that shock generated in a toner supply container is absorbed while a toner supply container is slid and moved.

Further, a toner supply container contains not only toner but may contain developing agent mixed with toner and a small amount of carrier. In recent years, there is available a so-called overflow type developing device that discharges amount of developer increased to a certain level and overflow while a new toner is supplied into a developer container according to density of developer. In the case of this overflow type-developing device, when not only new toner but also new carrier is supplied sequentially, the maintenance-free system requiring no exchange of developer by the maintenance can be realized. A toner supply container containing toner with a small amount of carrier mixed can be used for the supply of developer to such the overflow-type developing device.

What is claimed is:

1. An image forming apparatus, comprising:

a toner supply mechanism to supply toner to a developing device;

a supporting member to support a detachable toner supply container to the toner supply mechanism detachably, the toner supply container comprising a toner containing portion and an end portion thinner than the toner containing portion; and a buffering member having an elastic portion located on the bottom surface of the supporting member contacts the end portion when the end portion passes the buffering member, the elastic portion of the buffering member including a foaming member.

2. The image forming apparatus of claim 1, the buffering member including a foaming member and a sliding member on the surface of the foaming member.

3. The image forming apparatus of claim 2, the supporting member supporting the toner supply container provided with a cap portion.

4. The image forming apparatus of claim 2, the sliding member including a rotary member.

5. The image forming apparatus of claim 2 further comprising:

a second buffering member swingably projected from the bottom surface of the toner supply mechanism.

6. The image forming apparatus of claim 2 further comprising:

a first detecting member provided on the bottom surface of the inserting port side of the supporting member to detect the toner supply container.

7. The image forming apparatus of claim 1, the supporting member supporting the toner supply container provided with a cap portion.

8. The image forming apparatus of claim 1 further comprising:

a second buffering member swingably projected from the bottom surface of the toner supply mechanism.

9. The image forming apparatus of claim 1 further comprising:

a first detecting member provided on the bottom surface of the inserting port side of the supporting member to detect the toner supply container.

10. The image forming apparatus of claim 1, the sliding member including a rotary member.

11. The image forming apparatus of claim 1, further comprising:

a second buffering member swingably projected from the bottom surface of the toner supply mechanism.

* * * * *